US010583907B2

(12) United States Patent
Koyano

(10) Patent No.: US 10,583,907 B2
(45) Date of Patent: Mar. 10, 2020

(54) SMALL MARINE VESSEL

(71) Applicant: YAMAHA HATSUDOKI KABUSHIKI KAISHA, Iwata-shi, Shizuoka (JP)

(72) Inventor: Satoshi Koyano, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 16/190,444

(22) Filed: Nov. 14, 2018

(65) Prior Publication Data

US 2019/0185125 A1 Jun. 20, 2019

(30) Foreign Application Priority Data

Dec. 15, 2017 (JP) ..... 2017-240245

(51) Int. Cl.

| | |
|---|---|
| ***B63H 21/36*** | (2006.01) |
| ***B63H 21/00*** | (2006.01) |
| ***B63H 11/02*** | (2006.01) |
| *B63H 11/08* | (2006.01) |
| *B63H 11/00* | (2006.01) |

(52) U.S. Cl.

CPC ..... *B63H 21/36* (2013.01); *B63H 11/02* (2013.01); *B63H 21/24* (2013.01); *B63H 2011/008* (2013.01); *B63H 2011/081* (2013.01)

(58) Field of Classification Search

CPC ..... B63B 17/00; B63H 11/00; B63H 16/00; B63H 16/08; B63H 11/02; B63H 21/00; B63H 21/10; B63H 21/24; B63H 21/36

USPC ..... 440/38, 113; 114/343, 361

See application file for complete search history.

(56) References Cited

U.S. PATENT DOCUMENTS

| | | | | |
|---|---|---|---|---|
| 2004/0031430 | A1 | 2/2004 | Aube et al. | |
| 2005/0042946 | A1* | 2/2005 | Longpre | B63B 19/12 440/76 |
| 2014/0265413 | A1* | 9/2014 | Demo | B60R 13/0815 296/39.3 |
| 2016/0194067 | A1 | 7/2016 | Onodera | |

FOREIGN PATENT DOCUMENTS

| | | | |
|---|---|---|---|
| JP | 10-329786 | A | 12/1998 |
| JP | 2016-124443 | A | 7/2016 |

* cited by examiner

*Primary Examiner* — Lars A Olson

(74) *Attorney, Agent, or Firm* — Keating and Bennett, LLP

(57) ABSTRACT

A small marine vessel includes a vessel body, a propulsion device, a propulsion device housing provided in a rear portion of the vessel body and that houses the propulsion device, a first cover that substantially covers and seals the propulsion device housing, and a second cover disposed above the first cover and that covers the first cover and an opening of the propulsion device housing.

18 Claims, 5 Drawing Sheets

SMALL MARINE VESSEL

CROSS REFERENCE TO RELATED APPLICATIONS

This application claims the benefit of priority to Japanese Patent Application No. 2017-240245 filed on Dec. 15, 2017. The entire contents of this application are hereby incorporated herein by reference.

BACKGROUND OF THE INVENTION

1. Field of the Invention

The present invention relates to a small marine vessel.

2. Description of the Related Art

A small marine vessel including a propulsion device housing in which a propulsion device is disposed is known in general. Such a small marine vessel including a propulsion device housing in which a propulsion device is disposed is disclosed in Japanese Patent Laid-Open No. 2016-124443, for example.

Japanese Patent Laid-Open No. 2016-124443 discloses a jet boat including a boat body, an engine and a jet propulsion unit (propulsion device), and an engine housing provided in a rear portion of the boat body and that houses the engine and the jet propulsion unit. An opening of the engine housing of the jet boat is covered from above by only one hatch.

In the jet boat disclosed in Japanese Patent Laid-Open No. 2016-124443, the drive noise of the engine and the jet propulsion unit is likely to leak to the outside of the engine housing due to transmission of the drive noise through the hatch that covers the opening of the engine housing and leakage of the drive noise from a gap between the hatch and the boat body (opening), for example.

SUMMARY OF THE INVENTION

Preferred embodiments of the present invention provide small marine vessels that significantly reduce or prevent leakage of the drive noise of propulsion devices to the outside of propulsion device housings.

A small marine vessel according to a preferred embodiment of the present invention includes a vessel body, a propulsion device, a propulsion device housing provided in a rear portion of the vessel body and that houses the propulsion device, a first cover that substantially covers and seals the propulsion device housing, and a second cover disposed above the first cover and that covers the first cover and an opening of the propulsion device housing. The term "small marine vessel" refers to a marine vessel of less than about 20 tons gross tonnage, for example, but excludes a marine vessel (e.g., a so-called personal watercraft (PWC)) that a vessel occupant (vessel operator) operates while balancing his or her body.

A small marine vessel according to a preferred embodiment of the present invention includes the first cover that substantially covers and seals the propulsion device housing and the second cover disposed above the first cover and that covers the first cover and the opening of the propulsion device housing. Accordingly, the first cover that substantially covers and seals the propulsion device housing reduces the drive noise of the propulsion device that leaks from the propulsion device housing. Furthermore, the second cover that covers the first cover and the opening of the propulsion device housing further reduces the drive noise of the propulsion device reduced by the first cover. Consequently, leakage of the drive noise of the propulsion device to the outside of the propulsion device housing is significantly reduced or prevented. Therefore, conversations in the small marine vessel are less affected by the drive noise of the propulsion device such that vessel occupants are able to comfortably converse in the small marine vessel.

In a small marine vessel according to a preferred embodiment of the present invention, the first cover preferably has a flat plate shape, and the second cover preferably has a three-dimensional shape. Accordingly, even when a gap is likely to be created between the vessel body and the second cover due to the second cover having the three-dimensional shape, creation of a gap between the vessel body (opening) and the first cover is significantly reduced or prevented due to the flat plate shape of the first cover. Consequently, the drive noise of the propulsion device that leaks from the first cover is reliably reduced, and thus leakage of the drive noise of the propulsion device to the outside of the propulsion device housing is further significantly reduced or prevented.

A small marine vessel according to a preferred embodiment of the present invention preferably further includes an acoustic insulator attached to at least one of the first cover and the second cover. Accordingly, the acoustic insulator effectively and significantly reduces or prevents transmission of the drive noise of the propulsion device through at least one of the first cover and the second cover. Consequently, leakage of the drive noise of the propulsion device to the outside of the propulsion device housing is easily significantly reduced or prevented.

In a preferred embodiment of the present invention, the acoustic insulator is attached to the second cover and preferably seals the second cover to the vessel body. Accordingly, a gap between the second cover and the vessel body is blocked by the acoustic insulator, and thus the drive noise of the propulsion device that leaks from the second cover is further reduced.

A small marine vessel in which the acoustic insulator seals the second cover to the vessel body preferably further includes a second cover seal disposed outside the acoustic insulator attached to the second cover and that seals the second cover to the vessel body. Accordingly, not only the acoustic insulator but also the second cover seals or blocks the gap between the second cover and the vessel body, and thus the drive noise of the propulsion device that leaks from the second cover is still further reduced.

A small marine vessel according to a preferred embodiment of the present invention preferably further includes a first cover seal that seals the first cover to the propulsion device housing. Accordingly, the gap between the first cover and the vessel body (opening) is blocked by the first cover seal, and thus the drive noise of the propulsion device that leaks from the first cover is further reduced. Consequently, leakage of the drive noise of the propulsion device to the outside of the propulsion device housing is further significantly reduced or prevented.

In a small marine vessel according to a preferred embodiment of the present invention, the first cover preferably substantially covers and seals the propulsion device housing by being in contact with a support provided on an inner surface of the propulsion device housing and surrounding the propulsion device housing. Accordingly, the first cover substantially seals the propulsion device housing.

In a small marine vessel according to a preferred embodiment of the present invention, the propulsion device preferably includes a plurality of propulsion devices, and the propulsion device housing preferably houses the plurality of propulsion devices. Even when the drive noise of the plurality of propulsion devices in the propulsion device housing is louder than that of one propulsion device, the first cover and the second cover significantly reduce or prevent leakage of the drive noise of the propulsion devices to the outside of the propulsion device housing. Accordingly, even in a small marine vessel having a large output due to the plurality of propulsion devices, conversations are less affected by the drive noise of the propulsion devices such that the vessel occupants are able to comfortably converse in the small marine vessel.

In such a case, a small marine vessel according to a preferred embodiment of the present invention preferably further includes a partition wall that partitions the propulsion device housing such that the plurality of propulsion devices are partitioned from each other, and the first cover preferably is in contact with an upper end surface of the partition wall. Accordingly, the first cover is supported from below by the partition wall, and thus a state in which the first cover substantially covers and seals the propulsion device housing is reliably maintained.

In a small marine vessel according to a preferred embodiment of the present invention that further includes the partition wall, the partition wall is preferably detachable. Accordingly, the partition wall is detached during maintenance and inspection of the plurality of propulsion devices, for example, such that the partition wall is not an obstacle during maintenance and inspection of the plurality of propulsion devices.

In a small marine vessel according to a preferred embodiment of the present invention in which the second cover has the three-dimensional shape, the three-dimensional shape of the second cover protrudes or extends away from the first cover. Accordingly, a space between the first cover and the second cover is obtained while leakage of the drive noise of the propulsion device to the outside of the propulsion device housing is significantly reduced or prevented, and thus a space for an article housing, for example, is easily obtained.

In such a case, a small marine vessel according to a preferred embodiment of the present invention preferably further includes a seat including a seating surface and a backrest, and a portion of the second cover that faces away from the first cover preferably defines the seat. Accordingly, the portion of the second cover facing away from the first cover is used as the seat, and thus the vessel body is further downsized as compared with the case in which the seat is separately provided.

In a small marine vessel according to a preferred embodiment of the present invention that further includes the seat, a distance from an upper surface of the first cover to an upper surface of the second cover in an upward-downward direction is preferably greater than a distance from an upper surface of the seating surface of the seat to an upper end of the backrest in the upward-downward direction. Accordingly, a sufficiently large space is obtained between the first cover and the protruding second cover.

In a small marine vessel according to a preferred embodiment of the present invention in which the second cover has the protruding three-dimensional shape, the vessel body preferably includes a bulwark that protrudes upward to substantially prevent waves from entering the vessel, and a portion of the second cover that faces away from the first cover preferably defines a portion of the bulwark. Accordingly, the portion of the second cover facing away from the first cover defines a portion of the bulwark, and thus the vessel body is further downsized as compared with the case in which the bulwark is separately provided.

A small marine vessel according to a preferred embodiment of the present invention in which the first cover has a flat plate shape and the second cover has the three-dimensional shape preferably further includes an article housing provided between the flat plate-shaped first cover and the protruding second cover. Accordingly, the space between the flat plate-shaped first cover and the protruding second cover is effectively used.

A small marine vessel according to a preferred embodiment of the present invention preferably further includes a deck including an upper surface on which a vessel occupant moves, and the first cover is preferably located higher than the upper surface of the deck. Accordingly, the vessel occupants are able to easily open and close the first cover as compared with the case in which the first cover is disposed below the upper surface of the deck.

In a small marine vessel according to a preferred embodiment of the present invention, a portion of the second cover preferably is in contact with the vessel body below the first cover. Accordingly, a portion of a side surface of the first cover is also covered by the second cover, and thus leakage of the drive noise of the propulsion device to the outside of the propulsion device housing is further significantly reduced or prevented.

In a small marine vessel according to a preferred embodiment of the present invention, the first cover is preferably opened with an opening operation of the second cover such that the propulsion device housing is opened. Accordingly, when only the second cover is opened, the first cover is concurrently opened, and thus as compared with the case in which the opening operation of the first cover is performed separately after the opening operation of the second cover, the propulsion device housing is easily opened.

In a small marine vessel according to a preferred embodiment of the present invention, the propulsion device is preferably a jet propulsion device that jets water. Even when the propulsion device is a jet propulsion device, leakage of the drive noise of the jet propulsion device to the outside of the propulsion device housing is significantly reduced or prevented by the first cover and the second cover.

The above and other elements, features, steps, characteristics and advantages of preferred embodiments of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

The structures of jet boats according to preferred embodiments of the present invention is now described with reference to FIGS. 1 to 9. In the figures, arrow FWD represents the forward movement direction (bow side) of the jet boat 100, and arrow BWD represents the reverse movement direction (stern side) of the jet boat 100. A forward-rearward direction including the forward movement direction and the reverse movement direction is the same as the longitudinal direction of the jet boat 100. The short-side direction of the jet boat 100 is defined as a width direction.

The jet boat 100 is a so-called small marine vessel of less than about 20 tons gross tonnage, for example. Unlike a personal watercraft (PWC) that a boat occupant (boat operator) needs to operate while balancing his or her body, the jet boat 100 is operated by the boat occupant (boat operator) that operates a steering operator 6*d*.

Figure 1:
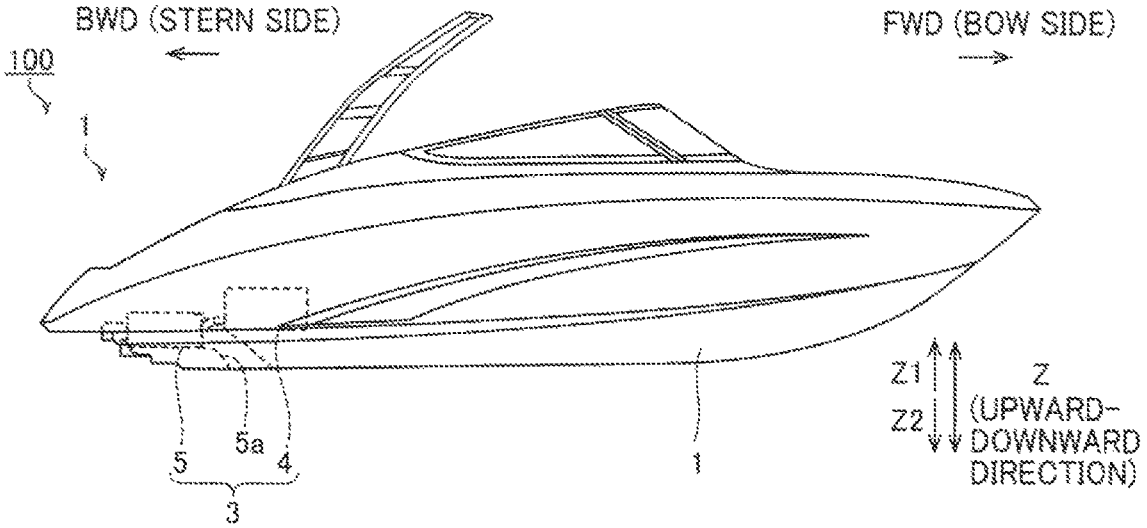
FIG. 1 is a side view of a jet boat according to a preferred embodiment of the present invention.
Figure 2:
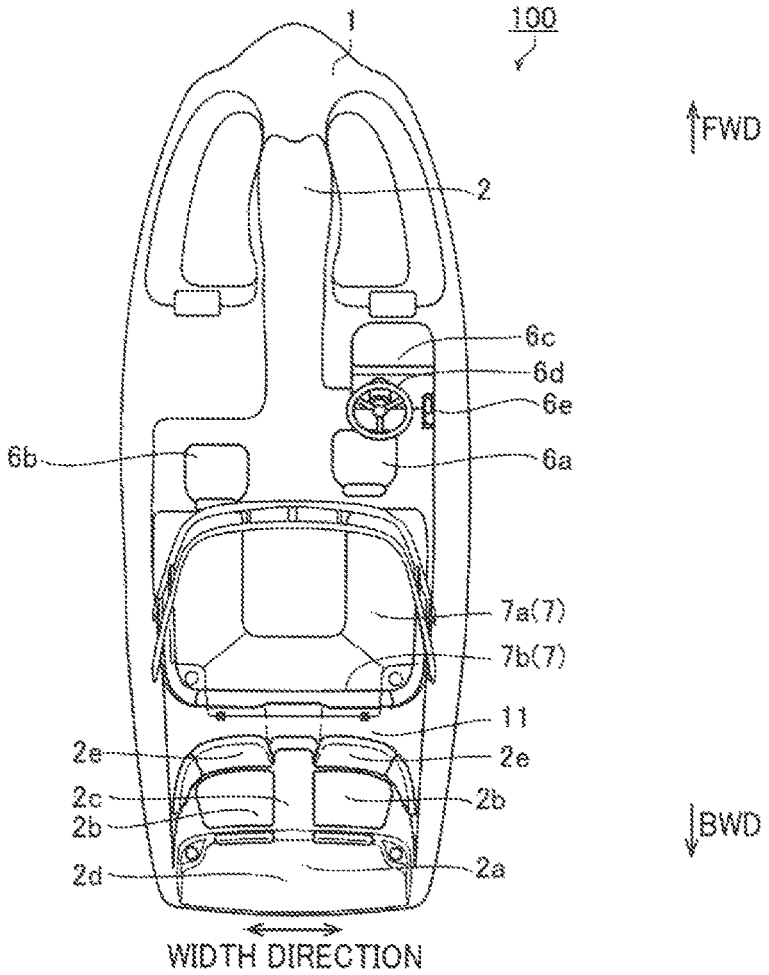
FIG. 2 is a top view of a jet boat according to a preferred embodiment of the present invention.

As shown in FIGS. 1 and 2, the jet boat 100 includes a boat body 1, a deck 2 attached to the boat body 1 and including an upper surface on which a boat occupant moves, and a pair of jet propulsion devices 3. The jet propulsion devices 3 include engines 4 that generate a rotational drive force and jet propulsion units 5 that jet a water flow in a direction opposite to a traveling direction using the rotational drive force from the engines 4. When the jet propulsion devices 3 are driven, drive noise is generated. An intake gate 5*a* through which water is supplied to the jet propulsion units 5 is provided near the stern at a lower portion of the boat body 1. The jet propulsion devices 3 are examples of a "propulsion device."

The deck 2 extends from a front portion of the jet boat over a rear portion of the jet boat 100 beyond the center of the jet boat 100 in the forward-rearward direction. A driver's seat 6*a* and a passenger's seat 6*b* on which boat occupants are seated are disposed on the upper surface of the deck 2. A con-deck 6*c* is provided on the upper surface of the deck 2. The con-deck 6*c* includes the steering operator 6*d* through which the boat occupant (boat operator) operates the traveling direction of the jet boat 100 and a lever operator 6*e* through which the boat occupant (boat operator) operates the throttle and shifting of the jet propulsion devices 3.

A rear deck 2*a* is provided at the rear portion of the jet boat 100. The rear deck 2*a* includes an upper step 2*c* including a pair of rear seating surfaces 2*b* on which boat occupants are seated and a platform 2*d* located below and behind the upper step 2*c*. Backrests 2*e* are provided at locations corresponding to the pair of rear seating surfaces 2*b*.

A seat 7 is provided behind the con-deck 6*c* and the driver's seat 6*a* of the jet boat 100. The seat 7 is provided on both sides of the jet boat 100 in the width direction and on the rear side that connects the sides such that the seat 7 is U-shaped in a planar view.

Figure 3:
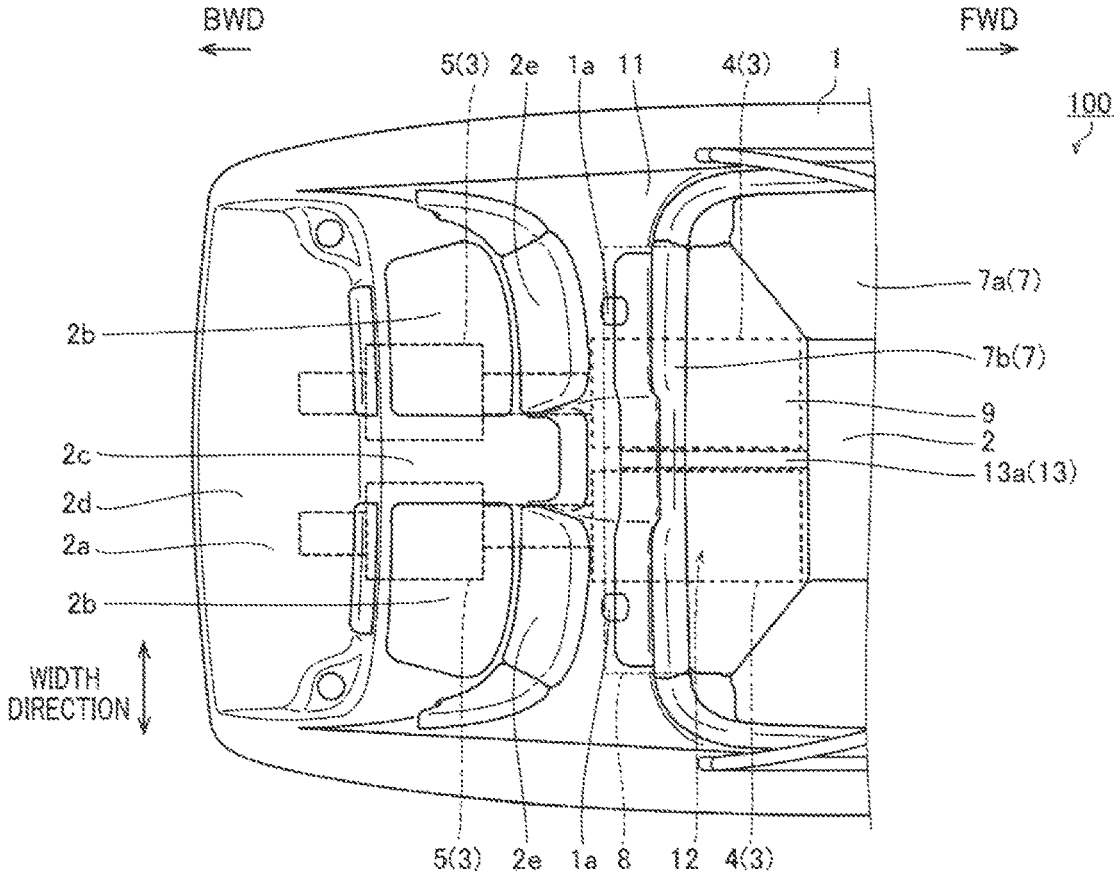
FIG. 3 is an enlarged top view of a rear portion of a jet boat according to a preferred embodiment of the present invention.

As shown in FIG. 3, the seat 7 is provided above the upper surface of the deck 2 and includes a seating surface 7*a* on which boat occupants are seated and a backrest 7*b* that extends upward from the rear end of the seating surface 7*a* and supports the boat occupants from the rear.

The boat body 1 includes a bulwark 11 that circumferentially surrounds the deck 2 from the outside. The bulwark 11 substantially prevents the entry of waves onto the deck 2.

The bulwark 11 has a substantially convex upward shape. The backrests 2*e* and 7*b* are respectively attached to portions of the bulwark 11 that extend in an upward-downward direction and correspond to the rear seating surfaces 2*b* and the seating surface 7*a*.

Figure 4:
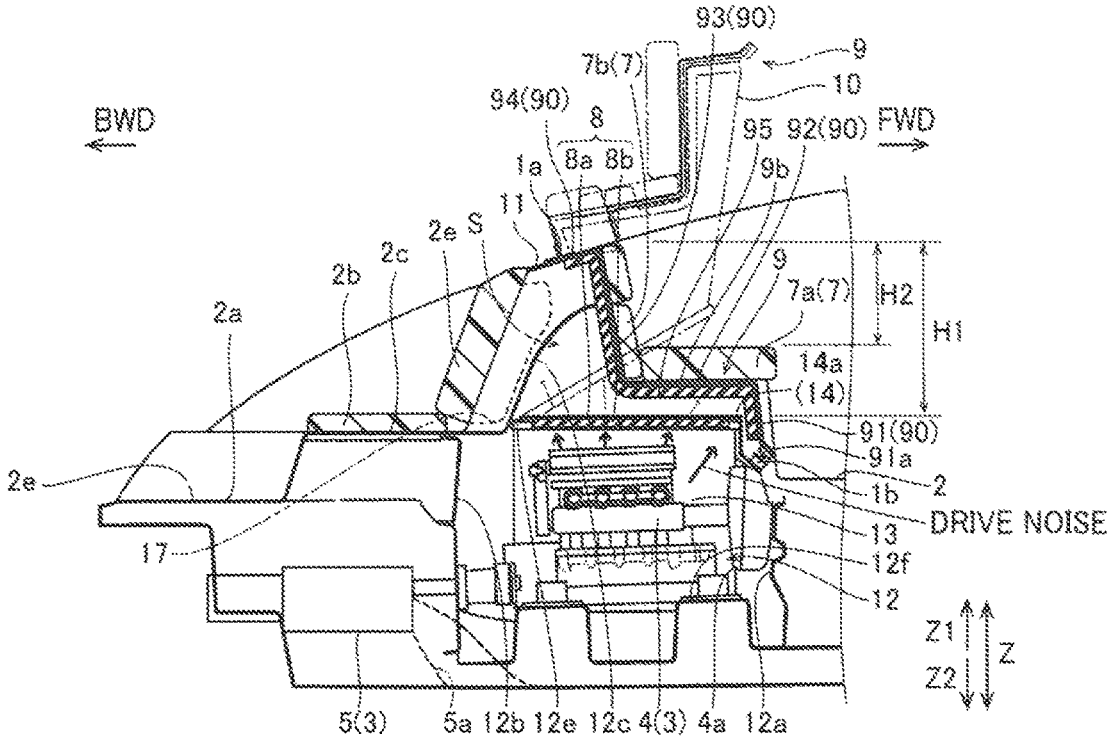
FIG. 4 is a sectional view of a rear portion of a jet boat according to a preferred embodiment of the present invention.

As shown in FIGS. 3 and 4, the boat body 1 includes a propulsion device housing 12 provided at the rear portion of the boat body 1 and that houses the pair of jet propulsion devices 3. The pair of jet propulsion devices 3 are housed side by side in the width direction in the propulsion device housing 12. The propulsion device housing 12 at least houses the entirety of the engines 4 of the jet propulsion devices 3. A majority of the jet propulsion units 5 are disposed behind the propulsion device housing 12.

The front inner surface 12*a* of the propulsion device housing 12 is located adjacent to the rear end of the deck 2 in the forward-rearward direction. Air cleaners 4*a* for the engines 4 are located adjacent to the front inner surface 12*a* in the forward-rearward direction. The rear inner surface 12*b* of the propulsion device housing 12 is located at substantially the same location as the front end of the upper step 2*c* (the rear end (lower end) of the bulwark 11) in the forward-rearward direction. A protruding surface 12*c* that protrudes forward from the rear inner surface 12*b* of the propulsion device housing 12 is provided at an upper portion of the propulsion device housing 12.

Figure 5:
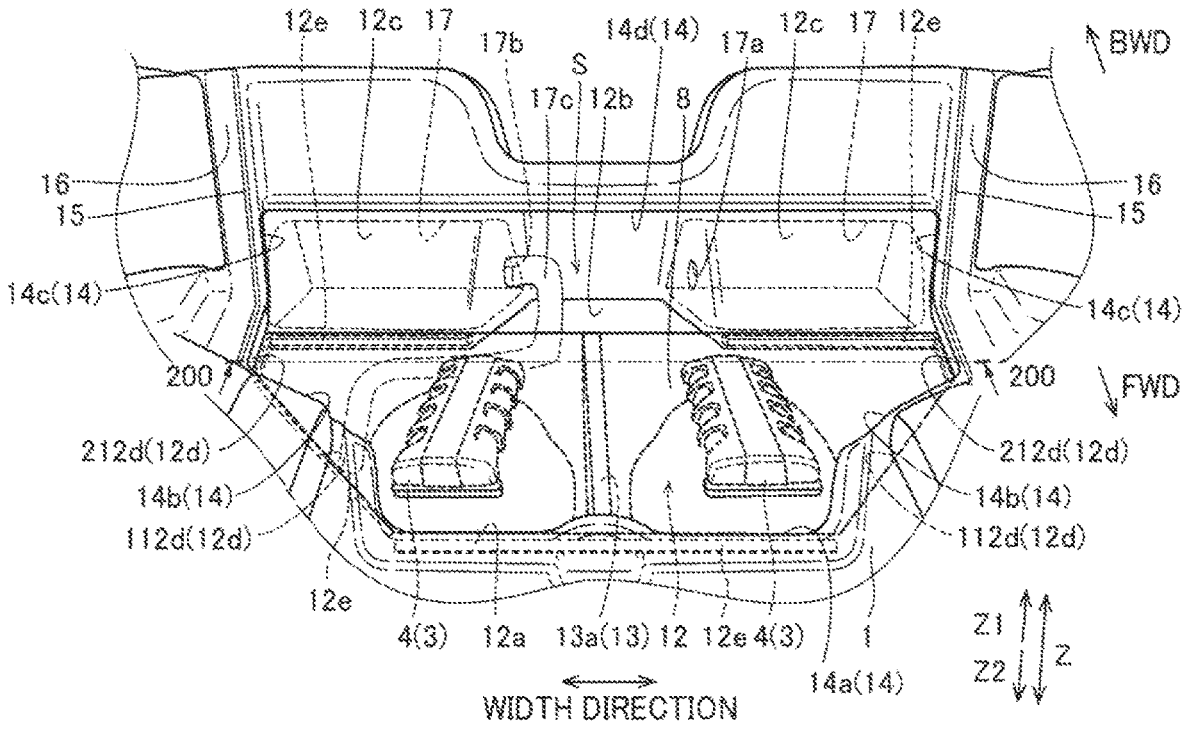
FIG. 5 is a diagram showing the periphery of a propulsion device housing in a state in which a hatch of a jet boat according to a preferred embodiment of the present invention is omitted.

As shown in FIG. 5, a pair of width-direction side inner surfaces 12*d* each include an inclined surface 112*d* inclined outward in the width direction from the front inner surface 12*a* toward the rear inner surface 12*b* (protruding surface 12*c*) and a rear surface 212*d* that extends in the forward-rearward direction.

A support 12*e* is provided on the front inner surface 12*a*, the protruding surface 12*c*, and the pair of width-direction side inner surfaces 12*d* of the propulsion device housing 12. The support 12*e* protrudes toward the inside of the propulsion device housing 12 above the upper surface of the deck 2.

A pair of engines 4 are fixed side by side in the width direction onto the bottom surface 12*f* of the propulsion device housing 12. A plate-shaped partition wall 13 disposed such that the thickness direction of the partition wall 13 coincides with the width direction of the jet boat 100 is disposed substantially at the center of the bottom surface 12*f* of the propulsion device housing 12 in the width direction. The partition wall 13 is sandwiched in the width direction by a pair of supports (not shown) that protrude upward from the bottom surface 12*f* of the propulsion device housing 12, for example, such that the partition wall 13 is fixed on the bottom surface 12*f* of the propulsion device housing 12. When the partition wall 13 is fixed as described above, the partition wall 13 is easily removed from the propulsion device housing 12 simply by moving the partition wall 13 upward.

As shown in FIG. 5, a three-dimensional opening 14 is provided to access the propulsion device housing 12 from the outside. Specifically, the opening 14 is defined by a first opening end 14*a*, a pair of second opening ends 14*b* connected to the first opening end 14*a*, and a pair of third opening ends 14*c* connected to the pair of second opening ends 14*b*, respectively, and a fourth opening end 14*d* connected to the pair of third opening ends 14*c*.

Similarly to the front inner surface 12*a*, the first opening end 14*a* is located adjacent to the rear end of the deck 2 in the forward-rearward direction. The first opening end 14*a* is located above the deck 2. The pair of second opening ends 14*b* are respectively provided on both sides of the first opening end 14*a* in the width direction at substantially the same height (substantially the same position in the upward-downward direction) as the first opening end 14*a*. Similarly to the pair of width-direction side inner surfaces 12*d*, the second opening ends 14*b* are inclined farther outward in the width direction in the more rearward portions thereof, and extend in the forward-rearward direction in rear portions thereof. The pair of third opening ends 14*c* respectively extend upward from the pair of second opening ends 14*b*. The fourth opening end 14*d* extends in the width direction so as to connect the pair of third opening ends 14*c* to each other. Consequently, the opening 14 has a three-dimensional shape in the upward-downward direction, the width direction, and the forward-rearward direction.

A protrusion 15 that protrudes toward a hatch 9 is provided in a portion of the boat body 1 adjacent to the opening 14. A groove 16 is circumferentially provided on the side of the protrusion 15 opposite to the opening 14.

Figure 6:
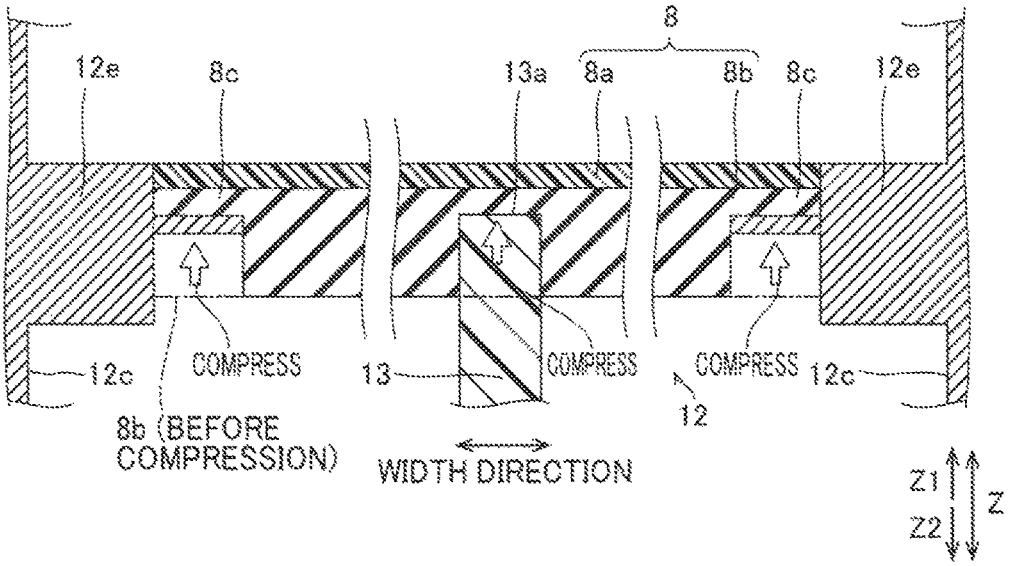
FIG. 6 is a sectional view taken along the line 200-200 in FIG. 5.

According to a preferred embodiment of the present invention, as shown in FIG. 5, the jet boat 100 includes an inner lid 8 that substantially covers and seals the entire propulsion device housing 12. One inner lid 8 covers both of the pair of jet propulsion devices 3. The inner lid 8 two-dimensionally covers the propulsion device housing 12 over the entire surface in the forward-rearward direction and the width direction. As shown in FIG. 6, the inner lid 8 includes an inner lid body 8*a* defining a flat plate-shaped (two-dimensional) member and an acoustic insulator 8*b* attached to the substantially entire lower surface of the inner lid 8. The inner lid 8 is an example of a "first cover".

The acoustic insulator 8*b* includes a soundproof material that absorbs sound such as a sponge material. The outer peripheral end of the acoustic insulator 8*b* is in contact with the support 12*e* provided on the front inner surface 12*a*, the protruding surface 12*c*, and the pair of width-direction side inner surfaces 12*d*. Consequently, the outer peripheral end of the acoustic insulator 8*b* is compressed between the inner lid body 8*a* and the support 12*e* to function as a seal 8*c* such that a seal is provided between the inner lid body 8*a* and the propulsion device housing 12. As a result, the propulsion device housing 12 is tightly sealed by the inner lid 8. The support 12*e* is disposed above the upper surface of the deck 2 such that the inner lid 8 is supported from below by the support 12*e* and located higher than the upper surface of the deck 2. The seal 8*c* is an example of a "first cover seal".

As shown in FIG. 5, the inner lid 8 is not in contact with the rear inner surface 12*b* located rearward of the protruding surface 12*c* of the propulsion device housing 12 such that the inner lid 8 does not cover a portion of the rear of the propulsion device housing 12. However, the boat body 1 is located above the portion not covered by the inner lid 8, and thus the drive noise of the jet propulsion devices 3 is unlikely to leak directly to the outside of the propulsion device housing 12. Consequently, the inner lid 8 substantially covers and seals the propulsion device housing 12.

Consequently, the drive noise of the jet propulsion devices 3 (engines 4) that leaks from the inner lid 8 is reduced.

As shown in FIG. 6, the upper end surface 13*a* of the partition wall 13 is in contact from below with a substantially central portion of the lower surface of the inner lid 8 in the width direction. In the inner lid 8, a substantially central portion of the acoustic insulator 8*b* in the width direction is compressed between the inner lid body 8*a* and the partition wall 13.

According to a preferred embodiment of the present invention, as shown in FIG. 4, the jet boat 100 includes the hatch 9 that covers the inner lid 8 and the opening 14 of the propulsion device housing 12. One hatch 9 covers both of the pair of jet propulsion devices 3. The hatch 9 is rotatably attached to the boat body 1 by a hinge 1*a* provided at the upper end of the bulwark 11 of the boat body 1. Consequently, the hatch 9 is rotated with respect to the boat body 1 such that the hatch 9 is switched between a closed state in which the hatch 9 covers the opening 14 and an open state (shown by a two-dot chain line in FIG. 4) in which the hatch 9 does not cover the opening 14. In addition, the hatch 9 includes a pair of supports 9*a* (see FIG. 7) that support the hatch in the open state. The hatch 9 is an example of a "second cover".

As shown in FIG. 4, the hatch 9 includes a hatch body 90 having a three-dimensional shape corresponding to the three-dimensionally-shaped opening 14. The hatch 9 has a three-dimensional shape that protrudes or extends upward and away from the inner lid 8.

Specifically, the hatch body 90 includes a front portion 91 that extends in the upward-downward direction and a flat portion 92 located rearward of the front portion 91. The hatch body 90 further includes a rear portion 93 located rearward of the flat portion 92 and that extends in the upward-downward direction and an upper end 94 located rearward of the rear portion 93. Consequently, the hatch body 90 has a three-dimensional shape that protrudes or extends upward. A portion of the hatch 9 facing away from the inner lid 8 defines a front portion of the bulwark 11 that protrudes upward.

An engaging portion 91*a* that engages with an engaging portion 1*b* of the boat body 1 in the closed state is provided at the lower end of the front portion 91. The front portion 91 is disposed adjacent to the rear end of the deck 2 in the forward-rearward direction and located above the deck 2. When the hatch 9 is in the closed state, the front portion 91 is in contact with a portion of the boat body 1 adjacent to the first opening end 14*a* below the inner lid 8.

A cushion is disposed on the outer surface 9*b* of the flat portion 92 such that a portion of the hatch 9 that faces away from the inner lid 8 doubles as the seating surface 7*a* of the seat 7. Similarly, a cushion is disposed on the outer surface 9*b* of the rear portion 93 such that a portion of the hatch 9 that faces away from the inner lid 8 doubles as the backrest 7*b* of the seat 7. The flat portion 92 and the rear portion 93 cover the inner lid 8 and the opening 14 by contacting a portion of the boat body 1 adjacent to the second opening ends 14*b* when the hatch 9 is in the closed state. Consequently, the hatch 9 covers the inner lid 8 and the opening 14 of the propulsion device housing 12. The hinge 1*a* is fixed to the upper end 94.

Figure 7:
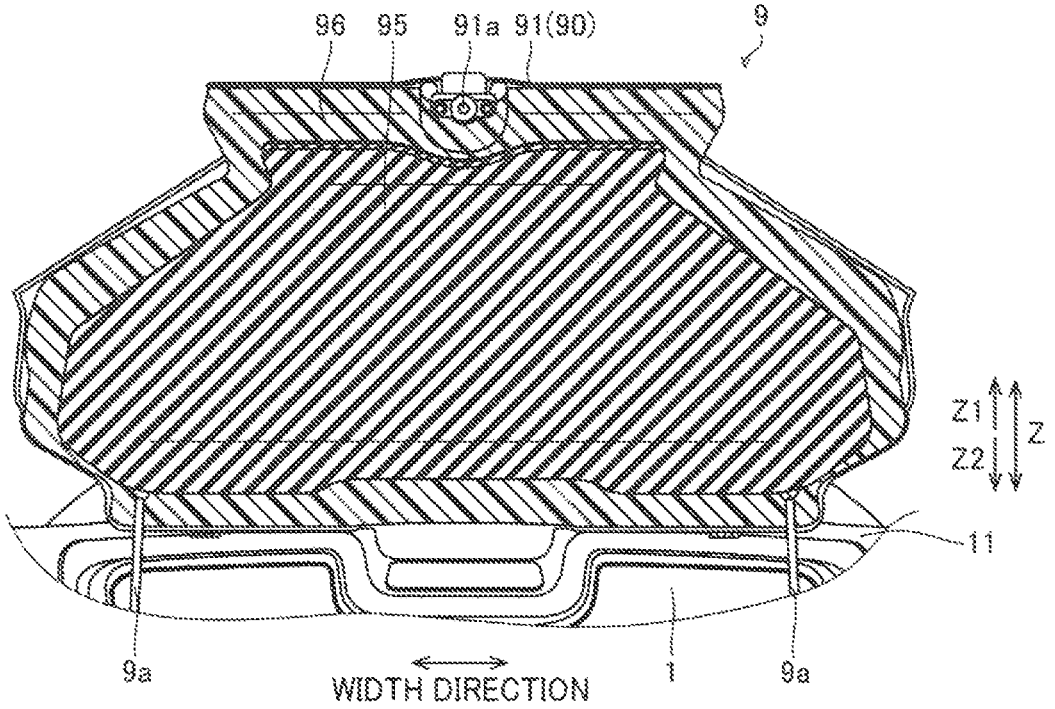
FIG. 7 is a diagram showing the open state of a hatch of a jet boat according to a preferred embodiment of the present invention.

As shown in FIGS. 4 and 7, an acoustic insulator 95 that absorbs sound and an outer seal 96 located outside the acoustic insulator 95 are provided on the inner surface of the hatch body 90 that faces the propulsion device housing 12. The acoustic insulator 95 is made of a soundproof material that absorbs sound such as a sponge material. The acoustic insulator 95 is provided on substantially the entire surface of the hatch body 90 that faces the propulsion device housing 12 but excluding an area adjacent to the outer end of the hatch body 90. The outer seal 96 is provided at and around the outer peripheral end of the acoustic insulator 95 and surrounds the acoustic insulator 95. The outer seal 96 is made of a member that is more elastic than the sponge material of which the acoustic insulator 95 is made, for example. The thickness of the acoustic insulator 95 is preferably greater than the thickness of the outer seal 96. For ease of understanding, in FIGS. 7 and 8, the acoustic insulator 95 is distinguished by hatching with thick lines, and the outer seal 96 is distinguished by hatching with alternate thin and thick lines. The outer seal 96 is an example of a "second cover seal".

Figure 8:
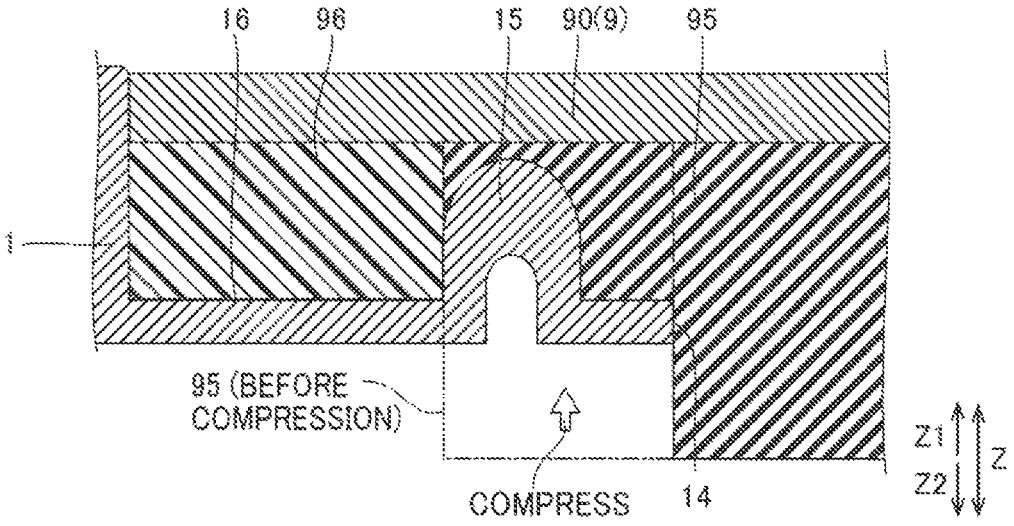
FIG. 8 is an enlarged sectional view showing a contact state between a boat body and a hatch of a jet boat according to a preferred embodiment of the present invention.

As shown in FIG. 8, when the hatch 9 is in the closed state, the outer seal 96 is disposed in the groove 16 so as to seal the hatch body 90 to the boat body 1. When the hatch 9 is in the closed state, the acoustic insulator 95 is compressed between the hatch body 90 and each of the protrusion 15 and a portion of the boat body 1 closer to the opening 14 than the protrusion 15 such that a seal is provided between the hatch body 90 and the boat body 1. Consequently, the acoustic insulator 95 seals the hatch body 90 to the boat body 1 such that the propulsion device housing 12 is tightly sealed.

Consequently, the drive noise of the jet propulsion deices 3 (engines 4) that leaks from the inner lid 8 is further reduced by the hatch 9.

Figure 9:
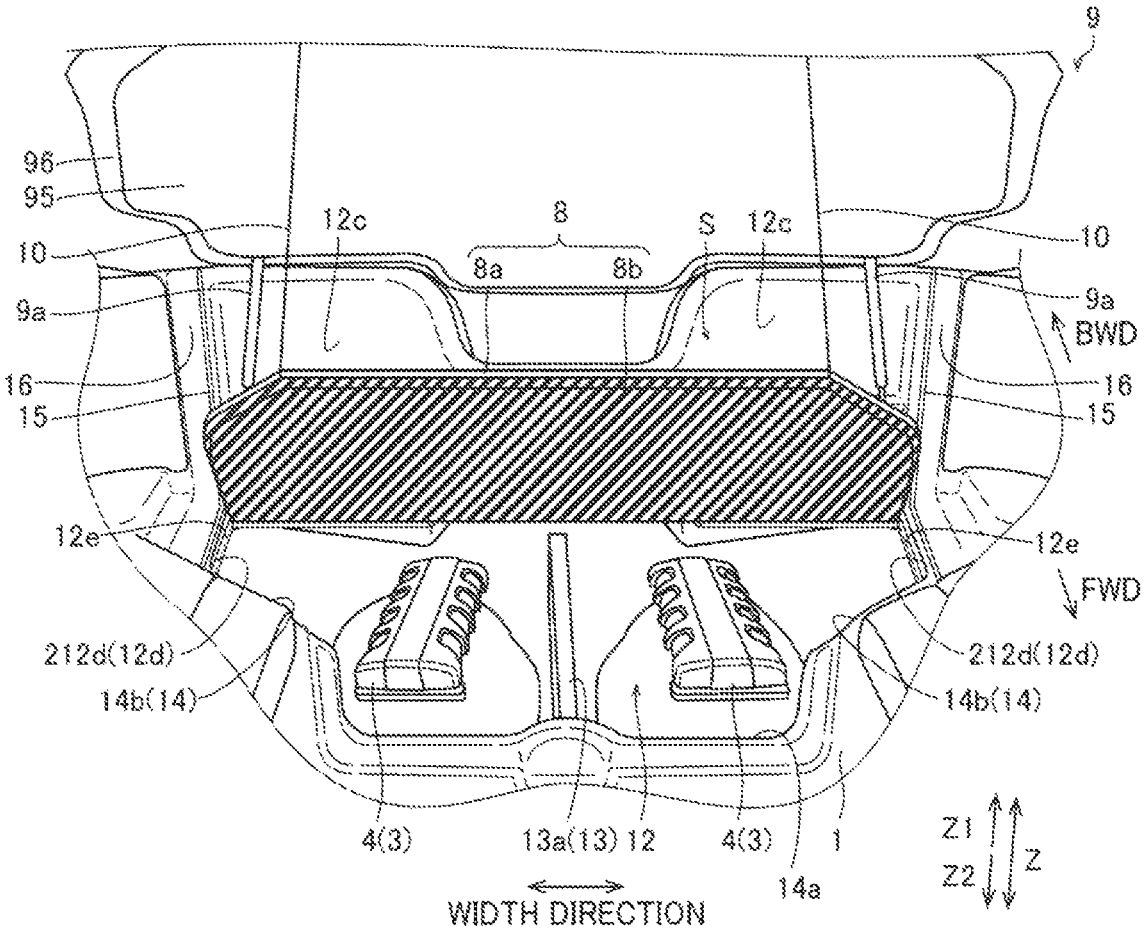
FIG. 9 is a diagram showing a state in which an inner lid is opened according to the opening operation of a hatch of a jet boat according to a preferred embodiment of the present invention.

As shown in FIGS. 4 and 9, the inner lid 8 and the hatch 9 are connected to each other by a pair of connectors 10. The connectors 10 are string-shaped members that connect the front end of the inner lid 8 to the front end of the hatch 9. The connectors 10 are loose when the hatch 9 is in the closed state. When the hatch 9 is opened to a certain extent, the looseness is eliminated, and an upward force starts being applied to the connectors 10. Consequently, the inner lid 8 is opened due to the opening operation of the hatch 9 such that the propulsion device housing 12 is opened.

As shown in FIG. 4, a distance H1 from the upper surface of the inner lid 8 to the upper surface of the hatch 9 in the upward-downward direction is greater than a distance H2 from the upper surface of the seating surface 7*a* of the seat 7 to the upper end of the backrest 7*b* in the upward-downward direction.

As shown in FIGS. 4 and 5, article housings 17 are provided in a space S between the flat plate-shaped inner lid 8 and the protruding hatch 9. A pair of article housings 17 are provided on both sides in the width direction in the space S. A pair of openable backrests 2*e* are opened to place articles in the article housings 17, or articles housed in the article housings 17 are taken out. In addition, an air intake port 17*a* through which outside air is supplied to the propulsion device housing 12 is provided in one of the article housings 17, and an air discharge port 17*b* through which air is discharged from the propulsion device housing 12 is provided in the other one of the article housings 17. A hose 17*c* that extends to a front portion of the propulsion device housing 12 is connected to the air discharge port 17*b*, and air in the front portion of the propulsion device housing 12 is discharged.

According to the various preferred embodiments of the present invention described above, the following advantageous effects are achieved.

According to a preferred embodiment of the present invention, the jet boat 100 includes the inner lid 8 that substantially covers and seals the propulsion device housing 12 and the hatch 9 disposed above the inner lid 8 and that covers the inner lid 8 and the opening 14 of the propulsion device housing 12. Accordingly, the inner lid 8 that substantially covers and seals the propulsion device housing 12 reduces the drive noise of the jet propulsion devices 3 that leaks from the propulsion device housing 12. Furthermore, the hatch 9 that covers the inner lid 8 and the opening 14 of the propulsion device housing 12 further reduces the drive noise of the jet propulsion devices 3 reduced by the inner lid 8. Consequently, leakage of the drive noise of the jet propulsion devices 3 to the outside of the propulsion device housing 12 is significantly reduced or prevented. Therefore, conversations in the boat are less affected by the drive noise of the jet propulsion devices 3 such that the boat occupants are able to comfortably converse in the jet boat 100.

According to a preferred embodiment of the present invention, the inner lid 8 preferably has a flat plate shape, and the hatch 9 preferably has a three-dimensional shape. Accordingly, even when a gap is likely to be created between the boat body and the hatch 9 due to the hatch 9 having a three-dimensional shape, creation of a gap between the boat body 1 (opening 14) and the inner lid 8 is significantly reduced or prevented due to the flat plate-shaped inner lid 8.

Consequently, the drive noise of the jet propulsion devices 3 that leaks from the inner lid 8 is reliably reduced, and thus leakage of the drive noise of the jet propulsion devices 3 to the outside of the propulsion device housing 12 is easily significantly reduced or prevented.

According to a preferred embodiment of the present invention, the acoustic insulator 8*b* is preferably attached to the inner lid 8 (inner lid body 8*a*), and the acoustic insulator 95 is attached to the hatch 9 (hatch body 90). Accordingly, the acoustic insulator 8*b* effectively and significantly reduces or prevents transmission of the drive noise of the jet propulsion devices 3 through the inner lid 8, and the acoustic insulator 95 effectively and significantly reduces or prevents transmission of the drive noise of the jet propulsion devices 3 through the hatch 9. Consequently, leakage of the drive noise of the jet propulsion devices 3 to the outside of the propulsion device housing 12 is further significantly reduced or prevented.

According to a preferred embodiment of the present invention, the acoustic insulator 95 is preferably attached to the hatch 9 and seals the hatch 9 (hatch body 90) to the boat body 1. Accordingly, a gap between the hatch 9 and the boat body 1 is blocked by the acoustic insulator 95, and thus the drive noise of the jet propulsion devices 3 that leaks from the hatch 9 is further reduced.

According to a preferred embodiment of the present invention, the outer seal 96 that seals the hatch 9 to the boat body 1 is provided outside the acoustic insulator 95 attached to the hatch 9. Accordingly, not only the acoustic insulator 95 but also the outer seal 96 block the gap between the hatch 9 and the boat body 1, and thus the drive noise of the jet propulsion devices 3 that leaks from the hatch 9 is still further reduced.

According to a preferred embodiment of the present invention, the jet boat 100 includes the seal 8*c* that seals the inner lid 8 to the opening 14 of the propulsion device housing 12. Accordingly, the gap between the inner lid 8 and the boat body 1 (opening 14) is blocked by the seal 8*c*, and thus the drive noise of the jet propulsion devices 3 that leaks from the inner lid 8 is further reduced. Consequently, leakage of the drive noise of the jet propulsion devices 3 to the outside of the propulsion device housing 12 is further significantly reduced or prevented.

According to a preferred embodiment of the present invention, the inner lid 8 substantially covers and seals the propulsion device housing 12 by contacting the support 12*e* provided on the inner surface of the propulsion device housing 12 so as to surround the propulsion device housing 12. Accordingly, the inner lid 8 easily seals the propulsion device housing 12.

According to a preferred embodiment of the present invention, the propulsion device housing 12 houses a plurality of jet propulsion devices 3. Even when the drive noise of the plurality of jet propulsion devices 3 in the propulsion device housing 12 is louder than that of a single jet propulsion device 3, the inner lid 8 and the hatch 9 significantly reduce or prevent leakage of the drive noise of the jet propulsion devices 3 to the outside of the propulsion device housing 12. Accordingly, even in the jet boat 100 having a large output due to the plurality of jet propulsion devices 3, conversations are less affected by the drive noise of the jet propulsion devices 3 such that the boat occupants are able to comfortably converse in the jet boat 100.

According to a preferred embodiment of the present invention, the inner lid 8 is in contact with the upper end surface 13*a* of the partition wall 13 that partitions the propulsion device housing 12 such that the plurality of jet propulsion devices 3 are partitioned from each other. Accordingly, the inner lid 8 is supported from below by the partition wall 13, and thus a state in which the inner lid 8 substantially covers and seals the propulsion device housing 12 is reliably maintained.

According to a preferred embodiment of the present invention, the partition wall 13 is detachable. Accordingly, the partition wall 13 is detached during maintenance and inspection of the plurality of jet propulsion devices 3, for example, such that the partition wall 13 is not an obstacle during maintenance and inspection of the plurality of jet propulsion devices 3.

According to a preferred embodiment of the present invention, the hatch 9 preferably has a three-dimensional shape that protrudes or extends away from the inner lid 8.

Accordingly, the space S between the inner lid 8 and the protruding hatch 9 is obtained while leakage of the drive noise of the jet propulsion devices 3 to the outside of the propulsion device housing 12 is significantly reduced or prevented, and thus a space in which the article housings 17 are disposed, for example, is easily obtained.

According to a preferred embodiment of the present invention, the portion of the protruding hatch 9 facing away from the inner lid 8 doubles as the seat 7 including the seating surface 7*a* and the backrest 7*b*. Accordingly, the portion of the hatch 9 facing away from the inner lid 8 is used as the seat 7, and thus the boat body 1 is further downsized as compared with the case in which the seat 7 is separately provided.

According to a preferred embodiment of the present invention, the distance H1 from the upper surface of the inner lid 8 to the upper surface of the hatch 9 in the upward-downward direction is greater than the distance H2 from the upper surface of the seating surface 7*a* of the seat 7 to the upper end of the backrest 7*b* in the upward-downward direction. Accordingly, a sufficiently large space is obtained between the inner lid 8 and the protruding hatch 9.

According to a preferred embodiment of the present invention, the portion of the protruding hatch 9 facing away from the inner lid 8 doubles as a portion (front portion) of the bulwark 11. Accordingly, the portion of the hatch 9 facing away from the inner lid 8 defines a portion of the bulwark 11, and thus the boat body 1 is further downsized as compared with the case in which the bulwark 11 is separately provided.

According to a preferred embodiment of the present invention, the article housings 17 are provided between the flat plate-shaped inner lid 8 and the protruding hatch 9. Accordingly, the space S between the flat plate-shaped inner lid 8 and the protruding hatch 9 is effectively used.

According to a preferred embodiment of the present invention, the inner lid 8 is located higher than the upper surface of the deck 2. Accordingly, the boat occupants are able to easily open and close the inner lid 8 as compared with the case in which the inner lid 8 is disposed below the upper surface of the deck 2.

According to a preferred embodiment of the present invention, the front portion 91 of the hatch 9 is in contact with the boat body 1 below the inner lid 8. Accordingly, a portion of a side surface of the inner lid 8 is also covered by the hatch 9, and thus leakage of the drive noise of the jet propulsion devices 3 to the outside of the propulsion device housing 12 is further significantly reduced or prevented.

According to a preferred embodiment of the present invention, the inner lid 8 is opened due to the opening operation of the hatch 9 such that the propulsion device housing 12 is opened. Accordingly, when only the hatch 9 is opened, the inner lid 8 is concurrently opened, and thus as compared with the case in which the opening operation of the inner lid 8 is performed separately after the opening operation of the hatch 9, the propulsion device housing 12 is easily opened.

According to a preferred embodiment of the present invention, the jet propulsion devices 3 jet water. Even when the jet propulsion devices 3 are designed as described above, leakage of the drive noise of the jet propulsion devices 3 to the outside of the propulsion device housing 12 is significantly reduced or prevented by the inner lid 8 and the hatch 9.

The preferred embodiments of the present invention described above are illustrative in all points and not restrictive. The extent of the present invention is not defined by the above description of the preferred embodiments but by the scope of the claims, and all modifications within the meaning and range equivalent to the scope of the claims are further included.

For example, while the jet boat 100 including the jet propulsion devices 3 (propulsion devices) is preferably shown as an example of a "small marine vessel" in preferred embodiments described above, the present invention is not restricted to this. The small marine vessel may alternatively be a small marine vessel including a so-called inboard motor(s) as a propulsion device(s), for example. In this case, the inboard motor(s) is provided in the vessel body of the small marine vessel, is substantially sealed by the first cover, and is housed in the propulsion device housing covered by the second cover.

While the inner lid 8 (first cover) preferably does not cover a portion of the rear of the propulsion device housing 12 in preferred embodiments described above, the present invention is not restricted to this. The first cover may alternatively cover the entire propulsion device housing. Furthermore, a portion of the propulsion device housing not completely covered by the first cover, such as a passage through which a hose passes, may alternatively be further provided. In this case, it is preferable that the portion of the propulsion device housing not completely covered by the first cover does not cause any problems (the propulsion device housing is preferably substantially sealed).

While the inner lid 8 (first cover) preferably has a flat plate shape in preferred embodiments described above, the present invention is not restricted to this. A portion of the first cover may alternatively have a three-dimensional shape. However, most of the first cover preferably has a flat plate shape.

While the acoustic insulators 8*b* and 95 are preferably provided in the inner lid 8 (first cover) and the hatch 9 (second cover), respectively, in preferred embodiments described above, the present invention is not restricted to this. An acoustic insulator may alternatively be provided only in one of the first cover and the second cover.

While the pair of jet propulsion devices 3 are preferably housed in one propulsion device housing 12 in preferred embodiments described above, the present invention is not restricted to this. Only one propulsion device may alternatively be housed in one propulsion device housing. In this case, the vessel body of the small marine vessel includes a propulsion device housing for each propulsion device. Furthermore, the vessel body of the small marine vessel includes a first cover and a second cover for each propulsion device housing. Alternatively, the small marine vessel may include only one propulsion device.

While the acoustic insulator 8*b* in the inner lid 8 (first cover) preferably doubles as the seal 8*c* in preferred embodiments described above, the present invention is not restricted to this. A seal may alternatively be provided separately from the acoustic insulator in the first cover, or only one of the seal and the acoustic insulator may alternatively be provided.

While the acoustic insulator 95 in the hatch 9 (second cover) and the outer seal 96 are preferably separately provided in preferred embodiments described above, the present invention is not restricted to this. In the second cover, the acoustic insulator and the outer seal may alternatively be integral and unitary with each other. Only one of the acoustic insulator and the outer seal may alternatively be provided.

While the partition wall 13 is preferably disposed in the propulsion device housing 12 in preferred embodiments described above, the present invention is not restricted to this. The partition wall may not be disposed in the propulsion device housing. In this case, the partition wall is not an obstacle, and thus maintenance and inspection of the propulsion devices are easily performed.

While the inner lid 8 (first cover) is preferably opened due to the opening operation of the hatch 9 (second cover) in preferred embodiments described above, the present invention is not restricted to this. The opening operation of the first cover and the opening operation of the second cover may not be interlocked. In this case, the first cover is detachable from the small marine vessel such that the first cover is prevented from becoming an obstacle during maintenance and inspection of the propulsion devices.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine vessel comprising:

a vessel body;

a propulsion device;

a propulsion device housing provided in a rear portion of the vessel body and that houses the propulsion device;

a first cover that substantially covers and seals the propulsion device housing;

a second cover disposed above the first cover and that covers the first cover and an opening of the propulsion device housing;

a first acoustic insulator attached to the first cover; and a second acoustic insulator attached to the second cover.

2. The marine vessel according to claim 1, wherein the first cover has a substantially flat shape; and the second cover has a three-dimensional shape.

3. The marine vessel according to claim 1, wherein the second acoustic insulator seals the second cover to the vessel body.

4. The marine vessel according to claim 3, further comprising a second cover seal that is disposed outside the second acoustic insulator and seals the second cover to the vessel body.

5. The marine vessel according to claim 1, further comprising a first cover seal that seals the first cover to the propulsion device housing.

6. The marine vessel according to claim 1, wherein the first cover substantially covers and seals the propulsion device housing by being in contact with a support provided on an inner surface of the propulsion device housing and surrounding the propulsion device housing.

7. The marine vessel according to claim 1, wherein the propulsion device includes a plurality of propulsion devices; and the propulsion device housing houses the plurality of propulsion devices.

8. The marine vessel according to claim 7, further comprising a partition wall that partitions the propulsion device housing such that the plurality of propulsion devices are partitioned from each other; wherein the first cover is in contact with an upper end surface of the partition wall.

9. The marine vessel according to claim 8, wherein the partition wall is detachable.

10. The marine vessel according to claim 2, wherein the three-dimensional shape of the second cover protrudes away from the first cover.

11. The marine vessel according to claim 10, further comprising a seat including a seating surface and a backrest; wherein a portion of the second cover that faces away from the first cover defines the seat.

12. The marine vessel according to claim 11, wherein a distance from an upper surface of the first cover to an upper surface of the second cover in an upward-downward direction is greater than a distance from an upper surface of the seating surface of the seat to an upper end of the backrest in the upward-downward direction.

13. The marine vessel according to claim 10, wherein the vessel body includes a bulwark that protrudes upward; and a portion of the second cover that faces away from the first cover defines a portion of the bulwark.

14. The marine vessel according to claim 10, further comprising an article housing provided between the first cover and the second cover.

15. The marine vessel according to claim 1, further comprising a deck including an upper surface on which a vessel occupant moves; wherein the first cover is located higher than the upper surface of the deck.

16. The marine vessel according to claim 1, wherein a portion of the second cover is in contact with the vessel body below the first cover.

17. The marine vessel according to claim 1, wherein the first cover is opened due to an opening operation of the second cover such that the propulsion device housing is opened.

18. The marine vessel according to claim 1, wherein the propulsion device is a jet propulsion device that jets water.

* * * * *